US007201668B1

(12) United States Patent
Pamias

(10) Patent No.: US 7,201,668 B1
(45) Date of Patent: Apr. 10, 2007

(54) REPLACEABLE HOSEL ASSEMBLY FOR GOLF CLUB

(76) Inventor: Francisco Pamias, 472 Marlboro Rd., Old Bridge, NJ (US) 08857

( * ) Notice: Subject to any disclaimer, the term of this patent is extended or adjusted under 35 U.S.C. 154(b) by 0 days.

(21) Appl. No.: 11/230,225

(22) Filed: Sep. 19, 2005

(51) Int. Cl.
*A63B 53/02* (2006.01)
*A63B 54/04* (2006.01)

(52) U.S. Cl. ..... 473/288; 473/309; 473/307; 473/313; 473/341

(58) Field of Classification Search ..... 473/340–341, 473/309, 313, 288, 307
See application file for complete search history.

(56) References Cited

U.S. PATENT DOCUMENTS 5,580,058 A * 12/1996 Coughlin ..... 273/250
5,692,969 A * 12/1997 Schooler ..... 473/313
6,652,390 B2 * 11/2003 Bradford ..... 473/341
6,769,994 B2 * 8/2004 Boone ..... 473/245
7,077,760 B2 * 7/2006 Gray ..... 473/313

* cited by examiner

*Primary Examiner*—Stephen Blau

(57) ABSTRACT

A replaceable hosel assembly for a golf club that enables a golfer to adjust an inclined angle of a putter shaft to a putter head, so as to satisfy a user's preference. A replaceable hosel assembly has an upper end adapted to fit the club shaft and the lower end fitted to the putter head. A plurality of removable hosel assemblies having pre-selected angles between the ends of the component, determines the golfer's preferred angle of inclination or lie angle.

4 Claims, 4 Drawing Sheets

REPLACEABLE HOSEL ASSEMBLY FOR GOLF CLUB

BACKGROUND OF THE INVENTION

1. Field of the Invention

The present invention relates to golf clubs, and more particularly to replaceable hosel assemblies for putters.

2. Description of the Related Art

Several designs for golf clubs have been designed in the past. None of them, however, disclose replaceable hosel assemblies for putters to accommodate the preference of a golfer.

In the game of golf it is often necessary to putt on the green. The putter club is very important and selecting the right club may be challenging at times. The golfer often searches for a putter that is comfortable and facilitates motion when striking a golf ball. However, different body-builds and putting stances cause many golfers to compromise their best "fit" because club manufacturers design clubs for the average person and not the individual. The one major variable in putter club "fit" is the desired inclination angle of the shaft to the putter head. This inclination angle is defined as the lie angle, which would best suit a golfer's stance and body-build.

There are no golf clubs to the best of applicant's knowledge that include replaceable hosel assemblies for putters to accommodate the preference of a golfer.

SUMMARY OF THE INVENTION

A replaceable hosel assembly for a golf putter, comprising an elongated club shaft having first and second ends. A plurality of replaceable hosels each comprise first and second elongated engagement elements and each have a different predetermined angle between their respective first and second elongated engagement elements. Each of the different predetermined angles establishing a 1-degree lie angle change between them and within a preferred lie angle range of 60 degree to 80 degree. Furthermore, each plurality of replaceable hosels has a proximal end and a distal end and each proximal end and a distal end has a longitudinal axis. The first elongated engagement element is substantially hollow to removably receive the first end, and the second elongated engagement element is solid. A putter head comprises a face and a base plate. The face is substantially perpendicularly disposed with respect to the base plate. The face is designed to strike a golf ball when putting. Angularly extending from the face are first and second sidewalls. The putter head further comprises a V-shaped top wall that connects the face to the first and second sidewalls. The V-shaped top wall has a merging point that comprises an aperture. The aperture has a channel. The aperture removably receives the second elongated engagement element and the channel receives the protrusion.

The present invention will enable a golfer to adjust his or her putter to the most suitable lie angle for that individual's body-build and stance. The instant invention can be used interchangeably for either right or left-hand putters.

It is therefore one of the main objects of the present invention to provide a replaceable hosel assembly for putters that when installed between the end of the shaft and the putter head, will enable a golfer to adjust his or her putter to a desired lie angle.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
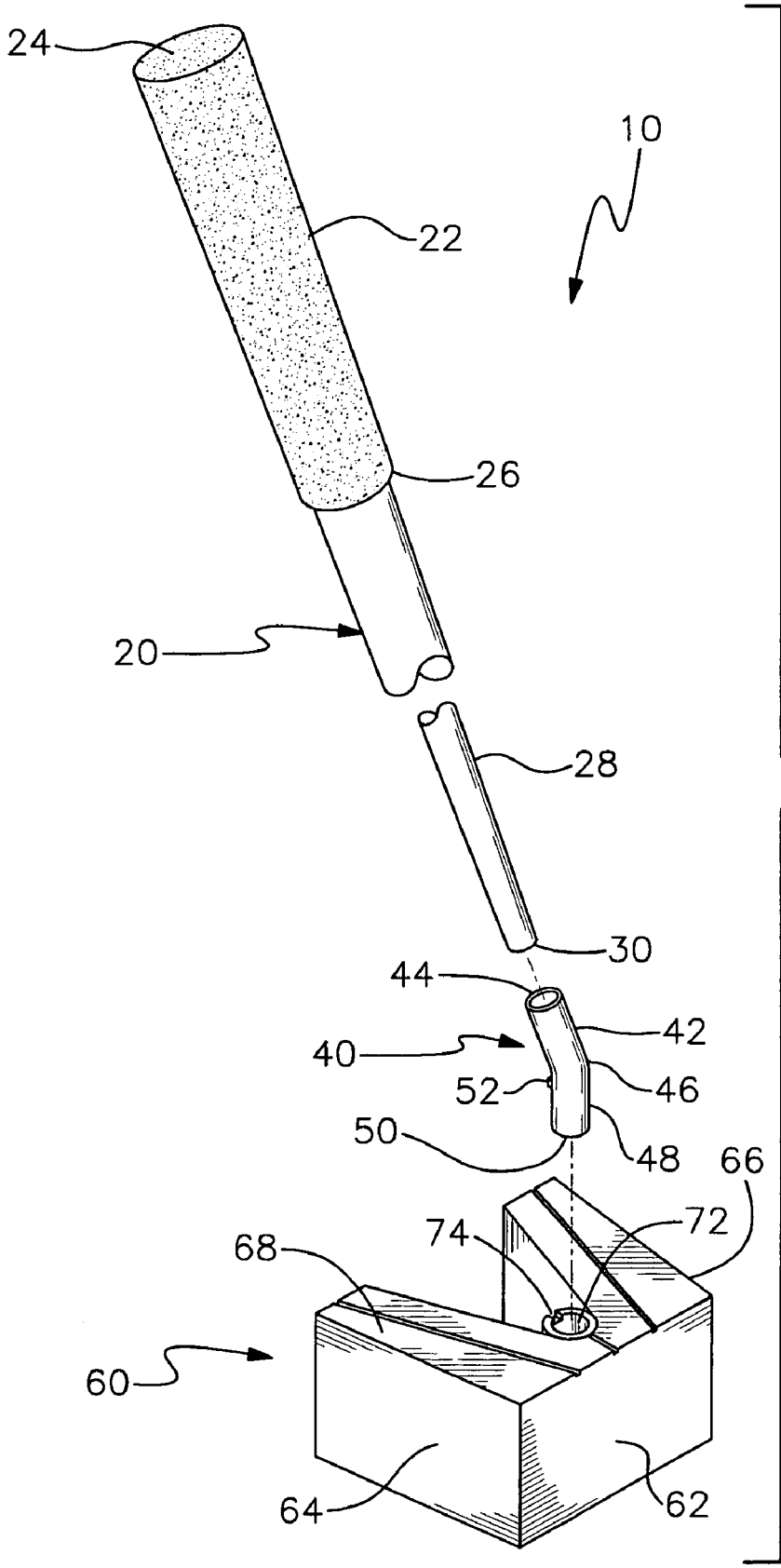
FIG. 1 represents an exploded view of the instant invention.
Figure 1D:
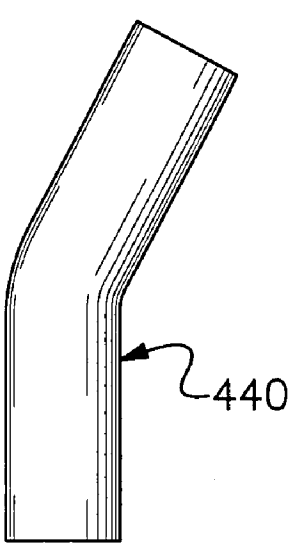
FIG. 1*d* illustrates a fourth alternate embodiment of the hosel assembly.
Figure 1C:
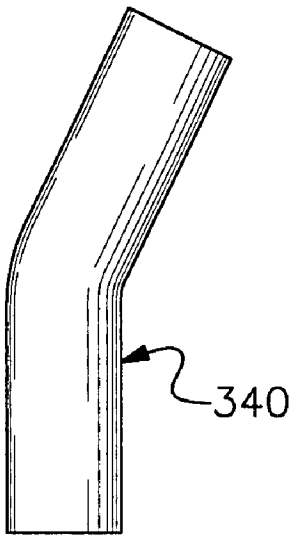
FIG. 1*c* illustrates a third alternate embodiment of the hosel assembly.
Figure 1B:
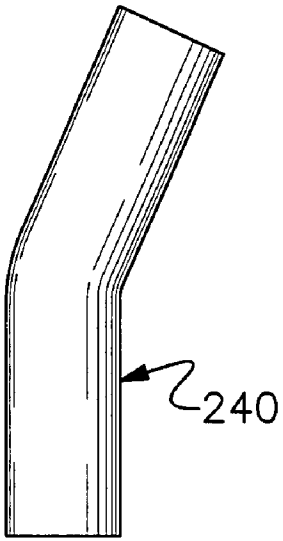
FIG. 1*b* illustrates a second alternate embodiment of the hosel assembly.
Figure 1A:
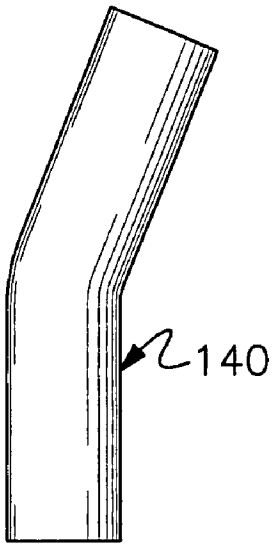
FIG. 1*a* illustrates a first alternate embodiment of the hosel assembly.

Referring now to the drawings, where the present invention is generally referred to with numeral 10, it can be observed that it basically includes shaft assembly 20, hosel 40, and putter head 60.

Figure 2:
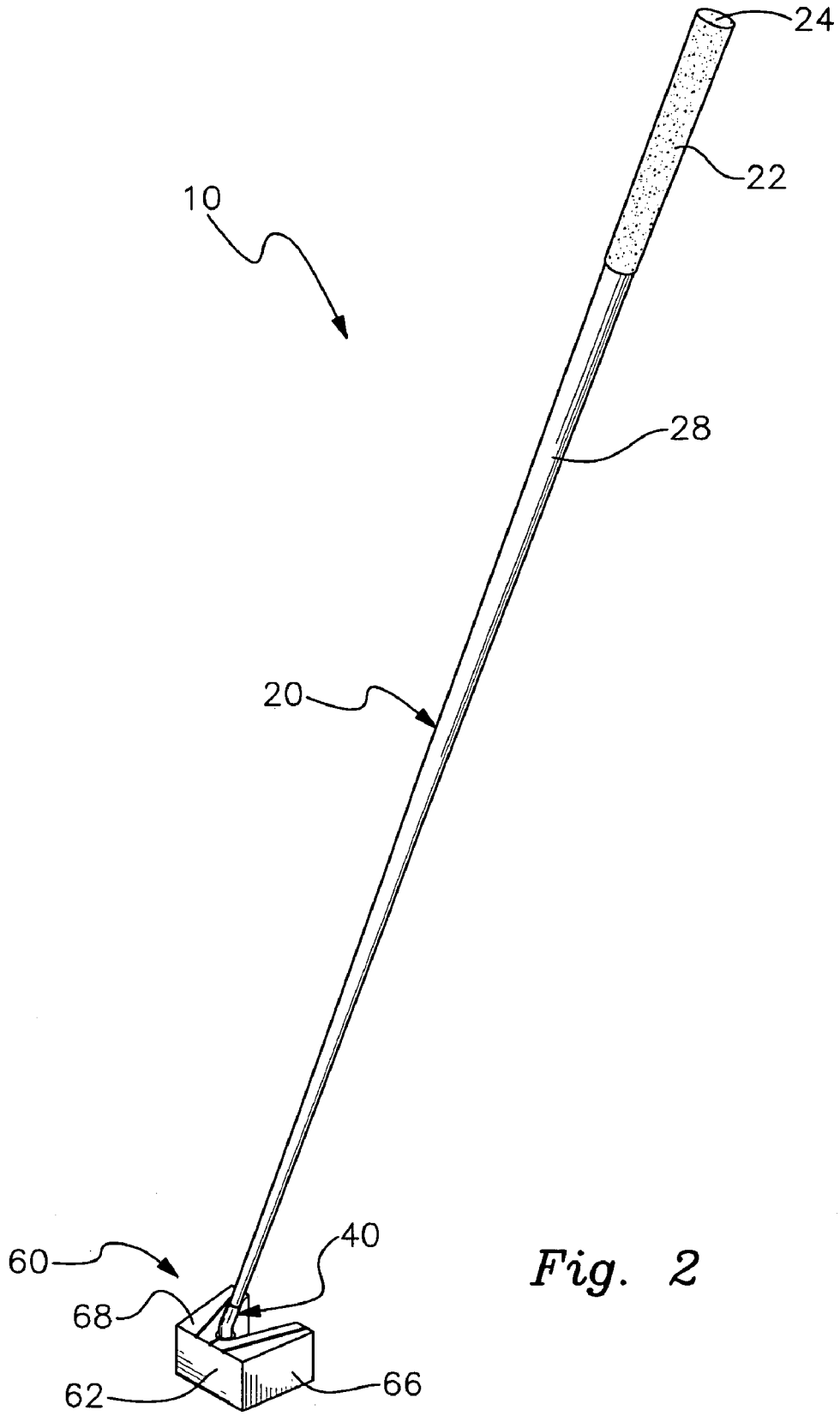
FIG. 2 shows the instant invention assembled from FIG. 1.
Figure 3:
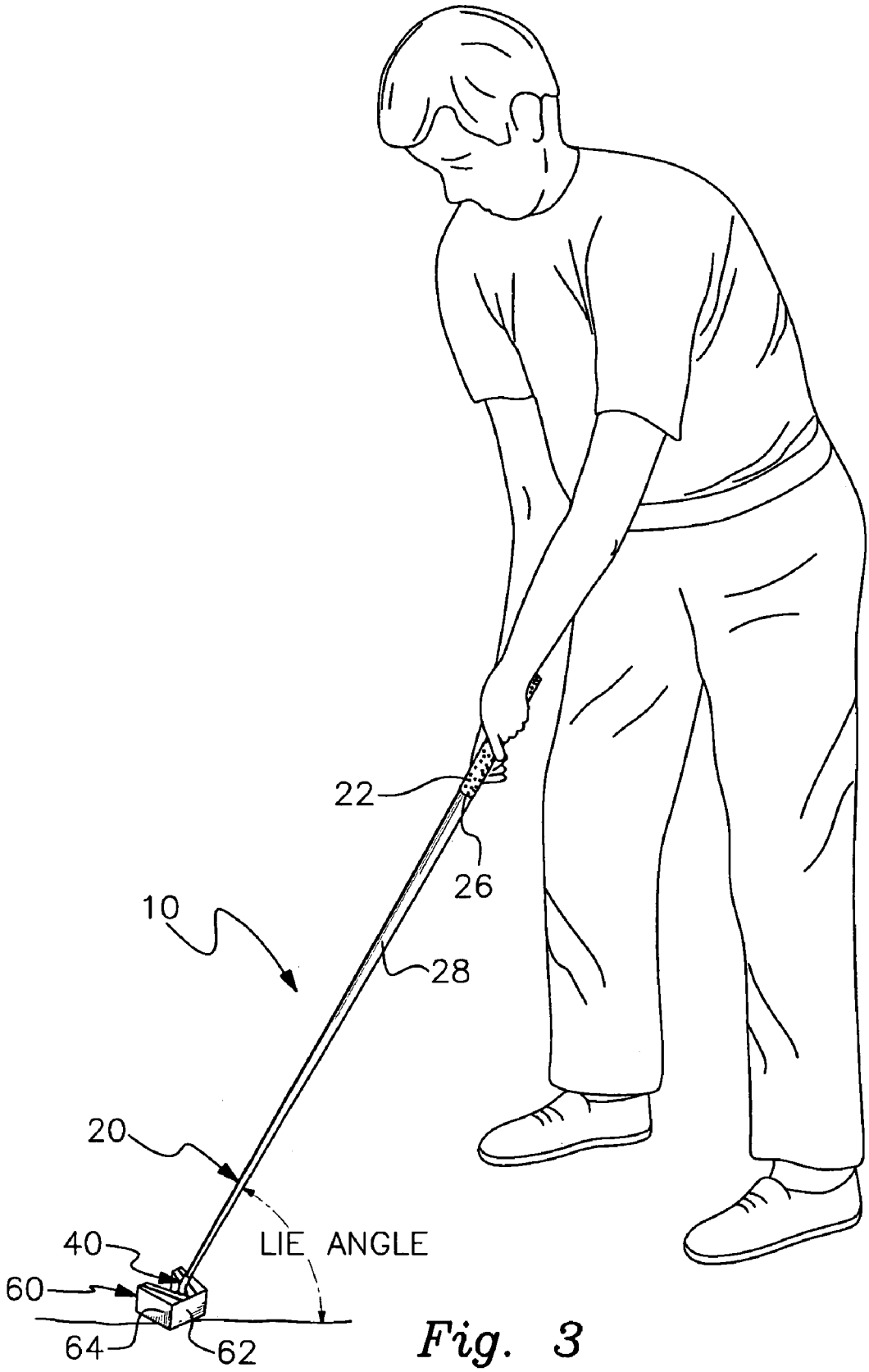
FIG. 3 illustrates a perspective view of a golfer using the instant invention of FIG. 2.

As seen in FIGS. 1 and 2, shaft assembly 20 comprises handle 22 having ends 24 and 26. Handle 22 is secured upon shaft 28. Shaft 28 has end 30. Hosel 40 comprises upper neck 42 and lower neck 48 that meet at elbow 46. Hosel 40 also has protrusion 52 and ends 44 and 50. It is noted that upper neck 42 is hollow and serves as a female fitting, and lower neck 48 is solid and serves as a male fitting. Putter head 60 comprises face 62. Angularly extending from face 62 are sidewalls 64 and 66. Top wall 68 forms a V-shape and connects face 62 to sidewalls 64 and 66 for structural stability. Opposite top wall 68 is a bottom wall, not seen, that defines a base plate. Located at the merging point of the V-shaped top wall 68 is aperture 72. Aperture 72 has channel 74 to receive protrusion 52.

For assembly, end 50 of hosel 40 is inserted into aperture 72 in the same manner as a shaft is commonly inserted into or onto conventional golf putter heads, and end 30 is inserted into upper neck 42.

Normally, putter heads are connected to the shaft in either of two ways:

1. The majority of putter heads have a hole or socket which is sized to receive a 0.370" diameter shaft, which is cemented in place; and 2. Other putter heads are connected to the shaft by an integral hosel or short metal stub (9/32" or 5/16" diameter), which is inserted and cemented inside a 0.370" outside diameter tubular, unitized metal shaft.

In the preferred embodiment, upper neck 42 is of a dimension to snugly receive end 30 of shaft 28, which typically has an outside diameter of 0.370". Therefore, upper neck 42 will have an inside diameter slightly greater than 0.370". Aperture 72 is of a dimension to snugly receive end 50 of lower neck 48, which has an outside diameter of 0.370" in the preferred embodiment. Therefore, aperture 72 will have an inside diameter slightly greater than 0.370".

Seen in FIGS. 1*a*, 1*b*, 1*c*, and 1*d*, are alternate embodiments of hosel 40, defined as hosels 140; 240; 340, and 440 respectively, which effectively change the lie angle of the club to best suit an individual's body-build and stance. Although not illustrated, the alternate embodiments of hosel 40 offer a 1 degree to 2 degree lie angle change establishing a preferred lie angle range of 60 degree to 80 degree. The golfer selects and installs the hosel that is best suited for his or her preferred lie angle.

Instant invention 10 allows a golfer to acquire a single shaft assembly, a single putter head, and a plurality of hosels of various angles. The golfer then determines the angle of inclination that best suits his or her stance to form a customized putter for that individual to establish a preferred lie angle that is typically in the range from 60 degree to 80 degree from the plane of the putter head 60 to the shaft 28.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A replaceable hosel assembly for a golf putter, comprising:

A) an elongated club shaft having first and second ends;

B) a plurality of replaceable hosels each comprising first and second elongated engagement elements and each having a different predetermined angle between their respective first and second elongated engagement elements, each of said different predetermined angle establishing a 1 degree lie angle change between them and within a lie angle range of 60 degree to 80 degree, furthermore each plurality of replaceable hosels having a proximal end and a distal end and each proximal end and a distal end has a longitudinal axis, said first elongated engagement element being substantially hollow to removably receive said first end, and said second elongated engagement element being solid, said second elongated engagement element comprising a protrusion located at a first predetermined distance from said distal end and adjacent to said first elongated engagement element; and C) a putter head comprising a face and a base plate, said face being substantially perpendicularly disposed with respect to said base plate, said face designed to strike a golf ball when putting, angularly extending from said face are first and second sidewalls, said putter head further comprises a V-shaped top wall that connects said face to said first and second sidewalls, said V-shaped top wall having a merging point that comprises an aperture, said aperture having a channel extending towards said base plate a second predetermined distance and not reaching said base plate, said aperture removably receives said second elongated engagement element and said channel receives said protrusion.

2. The replaceable hosel assembly for a golf putter set forth in claim 1, further characterized in that said V-shaped top wall is substantially planer.

3. The replaceable hosel assembly for a golf putter set forth in claim 2, further characterized in that said face and said first and second sidewalls are a same height.

4. The replaceable hosel assembly for a golf putter set forth in claim 3, further characterized in that said V-shaped top wall and said base plate are substantially parallel with respect to each other.

* * * * *